US012740608B2

(12) United States Patent
Foxman

(10) Patent No.: US 12,740,608 B2
(45) Date of Patent: Sep. 22, 2026

(54) TOKEN HOUSING FOR FASHION ACCESSORIES

(71) Applicant: Ted Foxman, Encino, CA (US)

(72) Inventor: Ted Foxman, Encino, CA (US)

( * ) Notice: Subject to any disclaimer, the term of this patent is extended or adjusted under 35 U.S.C. 154(b) by 199 days.

(21) Appl. No.: 18/665,449

(22) Filed: May 15, 2024

(65) Prior Publication Data

US 2025/0351911 A1 Nov. 20, 2025

(51) Int. Cl.
*A42B 1/248* (2021.01)

(52) U.S. Cl.
CPC ..... *A42B 1/248* (2013.01)

(58) Field of Classification Search
CPC ..... A42B 1/248
USPC ..... 40/329
See application file for complete search history.

(56) References Cited

U.S. PATENT DOCUMENTS 6,142,348 A 11/2000 Park
6,154,992 A * 12/2000 Lee ..... G09F 3/20 40/329
6,651,368 B1 * 11/2003 Blanks, I ..... A47G 19/2227 40/765
2001/0016526 A1 8/2001 Tate
2004/0079011 A1 * 4/2004 Shwartz ..... G09F 5/00 40/329
2006/0005361 A1 1/2006 O' Banion
2008/0072466 A1 * 3/2008 Fenner ..... G09F 21/02 40/586
2014/0295998 A1 10/2014 Gilbert
2017/0262884 A1 9/2017 Miller et al.
2023/0292896 A1 9/2023 Hynecek et al.

OTHER PUBLICATIONS

International Search Report and Written Opinion issued in International Patent Application No. PCT/US2025/029522, mailed Jul. 10, 2025 (Jul. 10, 2025). 15 pages.

* cited by examiner

*Primary Examiner* — Kyle R Grabowski
(74) *Attorney, Agent, or Firm* — Mintz Levin Cohn Ferris 1Glovsky and Poneo. P.C

(57) ABSTRACT

Methods, devices, and systems are described for token housings for fashion accessories. The system includes a token housing configured to selectively couple to a token. The token housing has a front side configured to receive the token and the token housing has a backside coupled to a magnetic bar. The magnetic bar extends between a first inner side point and a second inner side point of the token housing. The magnetic bar having a magnet configured to couple to the token. The system includes a clothing item or a fashion accessory coupled to the token housing. The token is configured to be removed from the token housing in response to applying a force to the token. The token housing is configured to retain the token in response a movement of at least one of the clothing item or the fashion accessory coupled to the token housing.

13 Claims, 11 Drawing Sheets

TOKEN HOUSING FOR FASHION ACCESSORIES

TECHNICAL FIELD

The present disclosure relates generally to token housings and is specifically concerned with a token housing coupled to clothing items or fashion accessories where the token housing is configured to at least one token, such as a token, that is detachable and interchangeable from the token housing.

BACKGROUND

Baseball caps are a popular type of headwear. Many baseball caps feature a logo, symbol, slogan, or design on the front face of the cap. Baseball caps with symbols, slogans, logos, or designs allow the wearer to express their allegiance to sporting teams, companies, artists, products, or affiliations. Additionally, these symbols, slogans, or decorative designs also allow the wearer to express their individual tastes in apparel. Currently, most baseball caps have a front-facing layer with a stiffening material for presenting these symbols, slogans, logos, or designs.

Unfortunately, most symbols, slogans, logos, or designs are either sewn or printed onto the front-facing layer of the baseball cap. This means that baseball caps are limited to displaying only one symbol, slogan, logo, or design. If the wearer desires to fashion a different logo or symbol, then the wearer must purchase another baseball cap bearing the desired logo or symbol. However, most baseball cap wearers prefer the fit and wear of certain baseball caps (and other types of headwear) but are unable to have a consistent experience for each symbol, slogan, logo, or design that they desire to fashion. Consequently, there is a need for a technical feature that allows different symbols, logos, and designs to be displayed on headwear (e.g., the front face of a baseball cap).

BRIEF DESCRIPTION OF THE DRAWINGS

The embodiments herein may be better understood by referring to the following description in conjunction with the accompanying drawings in which like reference numerals indicate identically or functionally similar elements, of which.

DETAILED DESCRIPTION

Figure 1:
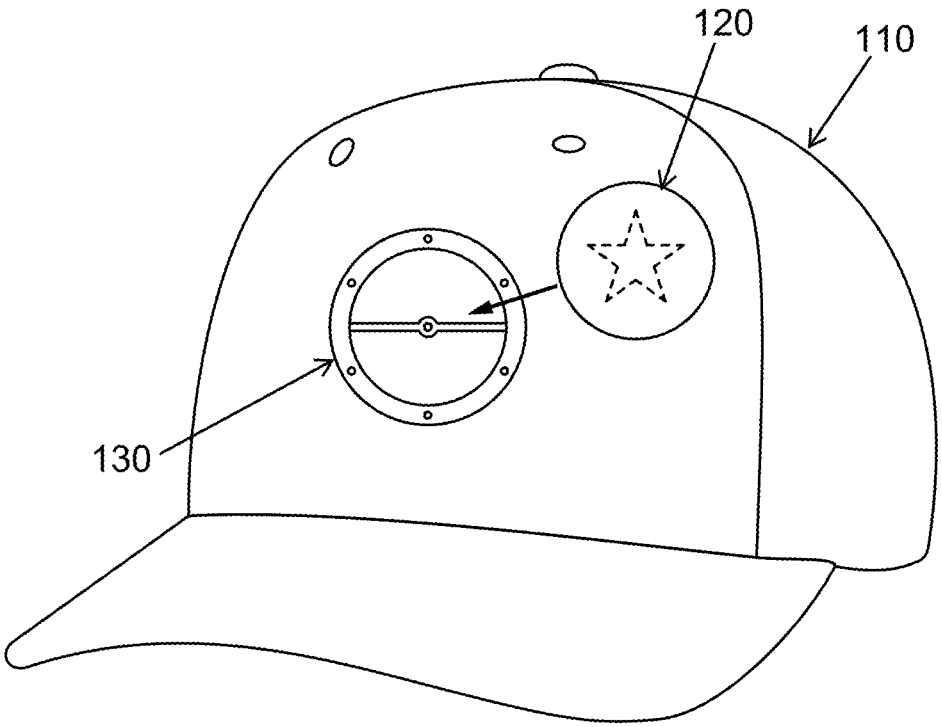
FIG. 1 depicts an example of a front view of a token housing mounted to a baseball cap, the token housing configured to receive a selectively attachable token.

The methods, systems, and apparatuses described herein are for a token housing for fashion accessories. In the following detailed description, reference is made to the accompanying drawings, which form a part hereof. In the drawings, similar symbols generally identify similar components, unless context dictates otherwise. The illustrative alternatives described in the detailed description, drawings, and claims are not meant to be limiting. Other alternatives may be used and other changes may be made without departing from the spirit or scope of the subject matter presented here. It will be readily understood that the aspects, as generally described herein, and illustrated in the Figures, can be arranged, substituted, combined, and designed in a wide variety of different configurations, all of which are explicitly contemplated and make part of this application.

The token housing described herein enables an easy and smooth exchange between different insertable tokens to be placed into token housing attached to fashion accessories. The token housing may provide flexibility in exchanging different medals that can be selectively attached and detached from the token housing. The token housing may provide either a magnetic coupling system or a selectively attachable rim system for selectively coupling and decoupling the different insertable tokens into the token housing attached to various fashion accessories (e.g., ballcaps and other headwear).

Unlike other systems, the token housing may provide a receptacle surface that is advantageous for exchanging medals and tokens. The receptacle surface is conducive for easily removing and inserting tokens. The receptacle surface may extend around the inside perimeter or the inside circumference of the token housing to provide a profile configured to receive an outer edge profile of various tokens. In some embodiments, the inner receptacle can have a smooth, jagged, or textured surface that at least partially extends around the inner perimeter or the inner circumference of the token housing. This jagged or textured inner surface may have a unique profile to allow proper orientation of the token in relation to the token housing. In some embodiments, the jagged or textured inner surface may have a unique profile to allow the coupling of tokens having a matching profile.

The token housing may be mounted to various fashion accessories (e.g., a ballcap). In relation to the fashion accessory to which the token housing is mounted, the token housing may provide a stand-off profile to make the token housing and insertable token stand off from the fashion accessory (e.g., the front side of the ball cap). In some embodiments, the token housing may have a flush profile for a continuous even surface between the fashion accessory (e.g., ball cap) and the token housing. The token housing may be sewn, embedded, adhered, Velcroed, or other otherwise attached to the fashion accessory. Other fashion accessories may include hats, footwear, shirts, belts, and other apparel.

The token housing may include a front side for receiving the token and a backside for removing the token. The token housing may be in a coupled state or a decoupled state with the selectively attachable token. The token housing may be in a coupled state in response to the selectively attachable token being magnetically attached to the magnetic bar. In the coupled state, the selectively attachable token may be flush with the front side of the token housing. The token housing may be in a decoupled state in response to the selectively attachable token being magnetically decoupled from the magnetic bar. In the decoupled state, the selectively attachable token may be displaced away from the front side of the token housing. In the coupled state, the selectively attachable token may be flush with the inner side edge of the token housing. In the decoupled state, the selectively attachable token may be displaced away from the inner side edge of the token housing. In some embodiments, the token housing may include a backside through which a force may be applied for decoupling the selectively attachable token from the token housing.

The token housing may be ring-shaped. The front side of the token housing may have a circular band with a circular cutout at the inner portion of the circular band. The circular band with the circular cutout extending along an inner circumference may form the ring shape of the token housing. The circular cutout may form an aperture extending between the inner circumference of the token housing. The token housing may include a magnetic bar inserted in the aperture. The magnetic bar may extend from one side of the circular cutout to the other side of the circular cutout to span the aperture and the inner diameter of the circular band. The magnetic bar may be magnetic for selectively attaching and removing the token inserted into the token housing. The token housing may include a backside. In some embodiments, the magnetic bar may be flush with the backside of the token housing or the magnetic bar may be mounted to the bottom of the backside of the token housing. In addition to the token housing having a ring shape, the token housing may have any circular curves, including an oval, an ellipse, or a circle.

In some embodiments, the token housing may be rectangular. The front side of the token housing may have a rectangular band with a rectangular cutout at the inner portion of the rectangular band. The rectangular band with the rectangular cutout extending along an inner perimeter may form the rectangular shape of the token housing. The rectangular cutout may form an aperture extending between the inner perimeter of the token housing. The token housing may include a magnetic bar inserted in the rectangular cutout and aperture. The magnetic bar may extend from one side of the rectangular cutout to the other side of the rectangular cutout to span the aperture and the inner area of the rectangular band. The magnetic bar may be magnetic for selectively attaching and removing the token inserted into the token housing. In addition to the token housing having a rectangular shape, the token housing may have any polygon shape, including a triangle, a square, a pentagon, a hexagon, a heptagon, an octagon, a decagon, or the like.

To facilitate transitioning between these states, the magnetic bar may form a magnetic bar opening between the magnetic bar and the inner side surface of the token housing. To transition from a coupled state to a decoupled state, a user may apply force to the token housing at a point corresponding to the magnetic bar openings formed by the magnetic bar. In response to applying force above one of the magnetic bar openings, the opposite end of the token is displaced above the surface of the token housing to allow for easy removal. For example, a finger or other object may push the front side of the selectively attachable token at a point located spatially above the magnetic bar opening between the magnetic bar and the token housing. In response to the finger pushing the front side spatially above the magnetic bar opening, an opposite end of the front side of the token is displaced away from the front side of the token housing. In another example, a finger or other object may push the backside of the token by applying force through the magnetic bar opening. In response to applying force at the backside of the selectively attachable token, the corresponding end of the selectively attachable token is displaced above the surface of the token housing.

In some embodiments, the thickness of the token housing may be approximately the same thickness as the token inserted into the token housing. In some embodiments, the thickness of the token housing may be approximately the same thickness as the token plus the thickness of the magnetic bar to allow the token to be flush with the front side of the token housing. The token housing may include an edge or projection that radially extends from the edge of the token housing for coupling the fabric of the fashion accessory to the token housing. The token housing may be coupled to the fashion accessory with an adhesive, stitching, snapping, heating, pressure, curating, compression, Velcro, and/or the like. The front side of the token housing may be made with a metal or metal alloy housing, a rubber material, a plastic material, a leather material, and/or the like.

In some embodiment, the token housing may be an overlapping rim token housing including a selectively couplable rim and an embedded housing interface. After inserting the token into the embedded housing interface, the selectively couplable rim may be configured to sustain the selectively attachable token against the embedded housing interface. The selectively couplable rim may have an outer surface and an inner surface. The outer surface of the selectively couplable rim may face away from the fashion accessory and the embedded housing interface and the inner surface may face towards the fashion accessory and the embedded housing interface. The selectively couplable rim of the selectively couplable rim may include a plurality of protrusions extending around the inside surface of the selectively couplable rim. The plurality of protrusions may extend around the circumference or perimeter of the inside surface of the selectively couplable rim. The plurality of protrusions may be selectively inserted into a plurality of recesses at the embedded housing interface for sustaining the selectively attachable token against the embedded housing interface.

In some embodiments, the token housing may have a back wall. The back-walled token housing may be the token housing with the ring shape or the token housing with the rectangular shape. Instead of a magnetic bar, a magnet may be mounted to the center portion of the back wall relative to the ring shape or the rectangular shape. The magnet may protrude off the surface of the back wall. The back-walled token housing may be in a coupled or uncoupled state with the selectively attachable badge. In the coupled state, a user may push the edge of the selectively attachable badge toward the back wall. The effect of pushing the selectively attachable badge toward the back wall may result in the opposite end of the token protruding away from the back wall of the badge housing. This protruding opposite end may allow a user to remove the selectively attachable badge.

FIG. 1 depicts an example of a front view of a token housing 130 mounted to a baseball cap. The token housing 130 may be embedded or integrated into baseball caps, headwear, or any other fashion accessories. The token housing 130 is configured to receive a selectively attachable token 120. A user may own several selectively attachable tokens for use with the token housing 130 coupled to the fashion accessory 110. This allows a popular or preferred fashion accessory 110 to be used with many different types of selectively attachable tokens.

The selectively attachable token 120 may be decorative on one side and include a symbol, logo, slogan, or design. For example, the logo can be that of a preferred sports team, brand, artist, or the like. The selectively attachable token 120 may be a token, an emblem, a mark, a memento, a trophy, a collectable, a coin, a precious metal, or a keepsake. The selectively attachable token 120 may be a rectangle, a square, a pentagon, a triangle, a pentagon, a hexagon, a heptagon, an octagon, a decagon, or any other polyangular shape. The selectively attachable token 120 may have any circular curves, including an oval, an ellipse, a circle, a ring, or any other curved features. In some embodiments, the backside of the selectively attachable token 120 may have an insignia and/or a number indicating rarity (e.g., 87 out of 1500). In some embodiments, the backside of the selectively attachable token 120 can have a QR code or other unique identifier. A computer application may be used to scan and store ownership information or a related collection of selectively attachable tokens.

The selectively attachable token 120 may include a data storage or other memory to track the ownership or the use of the selectively attachable token 120 and to maintain a record indicative of the authenticity of the selectively attachable token 120. In some embodiments, the data storage may include a unique identifier to track the ownership, the use, the sale, and the authenticity of the selectively attachable token. The unique identifier may be used for historical ownership purposes, archival purposes documenting authenticity, and verification of transferability. In some embodiments, the data storage may include a unique identifier for tracking the selectively attachable token 120 on a blockchain. The unique identifier may be maintained in a blockchain wallet for tracking the ownership or other use of the selectively attachable token 120 on a blockchain to ensure the authenticity and the ownership of the selectively attachable token. The data storage in the selectively attachable token 120 may be accessed using a port on the selectively attachable token 120. In some embodiments, the selectively attachable token 120 may be a non-fungible token.

The selectively attachable token 120 may include a wireless communication device. The wireless communication device may include one or more of a wireless duplexer, a wireless transmitter, a wireless receiver, a near-field communication (NFC) radio, an infra-red line of sight (LOS) circuit, a radio frequency identification (RFID) technology, or an ultra-wideband (UWB) radio. The selectively attachable token 120 may apply a Bluetooth protocol or other wireless protocol to be used for short-range communications or geofencing for spatial awareness. The selectively attachable token 120 may form an entity in a Bluetooth geofencing system that is uniquely identified within the network to facilitate personalized interactions and secure data exchange. Through the integration of wireless connectivity, the token establishes a communication link with nearby devices to enable seamless data transmission and interaction across various platforms.

Additionally, the wireless communication device embedded in the selectively attachable token 120 may enable the selectively attachable token 120 with spatial intelligence to define virtual boundaries and trigger predefined actions based on proximity to specific locations. This wireless communication device may be configured to communicate with various applications to generate location-based notifications, automated check-ins, and geographically restricted access control. In one example, a mobile device may notify a user when the wireless communication device is no longer in communication with the selectively attachable token 120. In another example, the wireless communication device can be used to identify the location of a misplaced or lost selectively attachable token 120. The geofencing functionality and technologies of the selectively attachable token 120 may interact with third party entities to offer increased functionality, such as notifications or participation in retail marketing campaigns.

The selectively attachable token 120 may couple to a centralized platform that manages token registrations, location data, and event triggers. The centralized platform may maintain authenticity records, sales records, privacy settings, and ownership information to ensure security and functionality with third-party applications and other wireless infrastructure. The centralized platform may keep track of when the unique identifier is accessed by a third-party entity or when the wireless communication device exchanges data with a third party entity. Additionally, robust security measures, such as encryption protocols and authentication mechanisms, may safeguard the integrity of data transmission and protect user privacy.

The selectively attachable token 120 may have a back edge configured to be inserted into the token housing 130 and an outer side edge configured to be received by the token housing 130. The outer side edge can have a profile that is configured to match a profile at the token housing 130. In some embodiments, the selectively attachable token 120 may have a smooth outer edge surface that is advantageous for exchanging tokens. The smooth outer side edge may extend around the outer perimeter or the outer circumference of the selectively attachable token 120 to provide a profile configured to be received at a corresponding perimeter or outer circumference at the embedded housing interface 710. In some embodiments, the outer side edge of the token 120 has a jagged or textured surface that at least partially extends around the outer perimeter or the outer circumference of the token 120. This jagged or textured outer surface may have a unique profile to allow proper orientation of the token 120 in relation to the token housing 130. In some embodiments, the jagged or textured outer side edge may have a unique profile to allow only the coupling of tokens with a matching profile at the token housing 130.

The token housing 130 provides a magnetic coupling system for selectively coupling and decoupling the different insertable tokens into the token housing 130 attached to various fashion accessories (e.g., ballcaps and other headwear). The token housing 130 may be mounted to various fashion accessories (e.g., a ballcap). In relation to the fashion accessory 110 to which the token housing 130 is mounted, the token housing 130 may provide a stand-off profile to make the token housing 130 and insertable token 120 stand off from the fashion accessory 110 (e.g., the front side of the ball cap). In some embodiments, the token housing 130 may have a flush profile for a continuous even surface between the fashion accessory 110 (e.g., ball cap) and the token housing 130. The token housing 130 may be sewn, embedded, adhered, Velcroed, or otherwise attached to the fashion accessory 110. Other fashion accessories may include hats, footwear, shirts, belts, shoes, jewelry, backpacks, luggage, and other apparel.

In some embodiments, the token housing 130 may include an edge or projection that radially extends from the edge of the token housing 130 for coupling the fabric of the fashion accessory 110 to the token housing 130. The token housing 130 may be coupled to the fashion accessory 110 with an adhesive, stitching, snapping, compression, Velcro, and/or the like. The front side of the token housing 130 may be made with a metal or metal alloy housing, a rubber material, a plastic material, a leather material, and/or the like.

Figure 2:
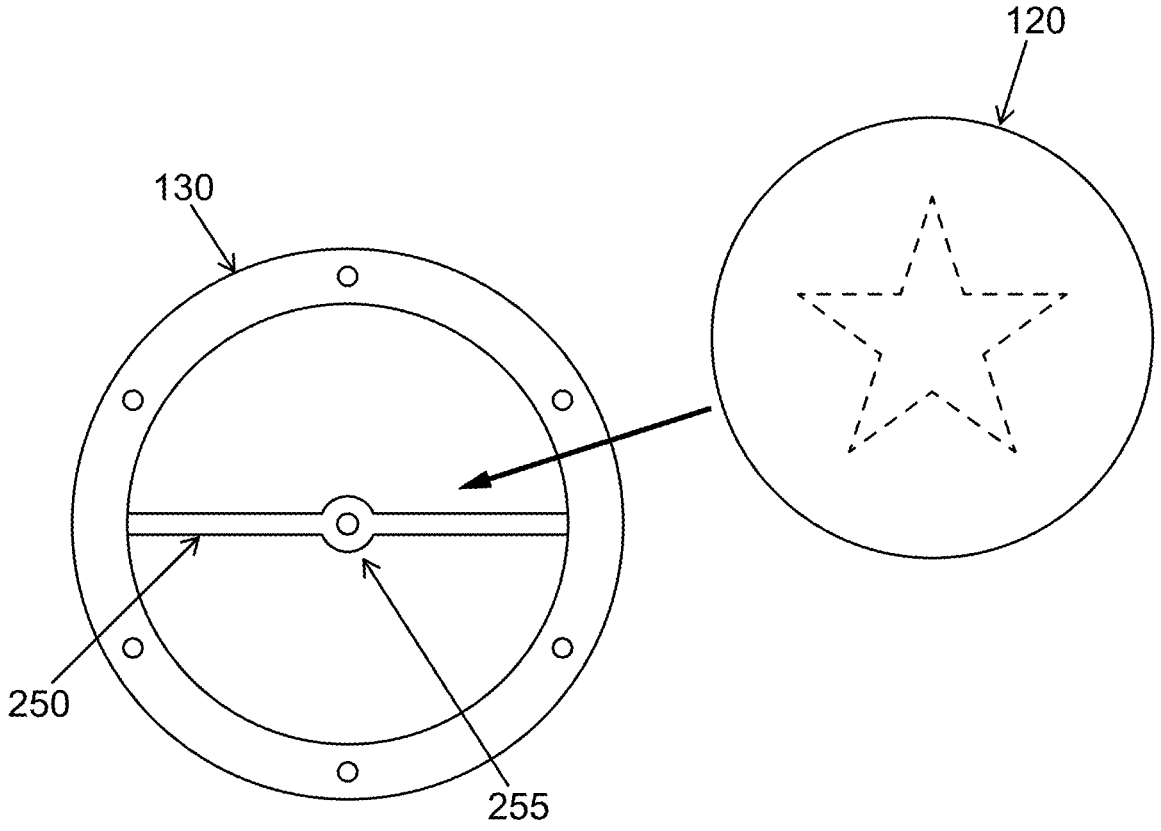
FIG. 2 depicts an example of a front view of a token housing with the selectively attachable token in a decoupled state to the token housing.

FIG. 2 depicts an example of a front view of a token housing 130 with the selectively attachable token 120 in a decoupled state to the token housing 130. The token housing 130 may include a front side and a back side opposite the front side. The front side and back side may be connected to an inner side edge and an outer side edge. The front side of the token housing 130 is configured to receive the selectively attachable token 120. The back side may include an opening to facilitate the removal of the selectively couplable selectively attachable token 120. The token may be the selectively attachable token 120.

The token housing 130 may be in a coupled state or a decoupled state with the selectively attachable token 120. The token housing 130 may be in a coupled state in response to the selectively attachable token 120 being magnetically attached to the magnetic bar 250. In the coupled state, the selectively attachable token 120 may be flush with the front side of the token housing 130. Additionally, the selectively attachable token 120 may be flush with the inner side edge of the token housing 130 in the coupled state. In the coupled state, the token housing 130 may retain the selectively attachable token 120 in response to shaking, jostling, vibrating, or any other repetitive or chaotic movement of the fashion accessory 110 coupled to the token housing 130.

The token housing 130 may be in a decoupled state in response to the selectively attachable token 120 being magnetically decoupled from the magnetic bar 250. In the decoupled state, the selectively attachable token 120 may be displaced away from the front side of the token housing 130. In the decoupled state, the selectively attachable token 120 may be displaced away from the inner side edge of the token housing 130. In some embodiments, the token housing 130 may include an opening at the backside through which a force may be applied to the attachable token 120 for decoupling the selectively attachable token 120 from the token housing 130.

In some embodiments, the token housing 130 may be ring-shaped. The front side of the token housing 130 may have a circular band with a circular cutout at the inner portion of the circular band. The circular band with the circular cutout extending along an inner circumference of the inner side edge may form the ring shape of the token housing 130. The circular cutout may form an aperture at the inner circumference of the inner side edge of the token housing 130. The token housing 130 may include a magnetic bar 250 inserted in the aperture between two points of the inner side edge. The magnetic bar 250 may span the aperture and extend from one side of the inner side edge to the other side of the inner side edge. The magnetic bar 250 may span the inner diameter of the inner side edge. The magnetic bar 250 may be magnetic for selectively attaching and removing the token 120 that is inserted into the token housing 130. The token housing 130 may include a backside. In some embodiments, the magnetic bar 250 may be flush with the backside of the token housing 130 or the magnetic bar 250 may be mounted to the bottom of the backside of the token housing 130. In addition to the token housing 130 having a ring shape, the token housing 130 may have any circular curves, including an oval, an ellipse, or a circle.

In some embodiments, the token housing 130 may be rectangular or square-shaped. The front side of the token housing 130 may have a rectangular band with a rectangular cutout at the inner portion of the rectangular band. The inner portion of the rectangular band may correspond to the inner side edge of the token housing 130. The rectangular band with the rectangular cutout extending along an inner perimeter of the inner side edge may form the rectangular shape of the token housing 130. The rectangular cutout may form an aperture extending between the inner side edge of the token housing 130. The token housing 130 may include a magnetic bar 250 inserted in the aperture. The magnetic bar 250 may extend from one side of the aperture to the other side of the aperture to span the inner area of the rectangular band. The magnetic bar 250 may be magnetic for selectively attaching and removing the token 120 inserted into the token housing 130. In addition to the token housing 130 having a rectangular shape, the token housing 130 may have any polygon shape, including a triangle, a square, a pentagon, a hexagon, a heptagon, an octagon, or a decagon.

To facilitate transitioning between these states, the magnetic bar 250 may form a magnetic bar opening 440 between the magnetic bar 250 and the inner side surface of the token housing 130. To transition from a coupled state to a decoupled state, a user may apply force to the token 120 at a point corresponding to the magnetic bar openings 440 formed by the magnetic bar 250. In response to applying force above the one or openings, the opposite end of the token 120 is displaced above the surface of the token housing 130 to allow for easy removal. For example, a finger or other object may push the front side of the selectively attachable token at a point spatially above the magnetic bar opening 440 between the magnetic bar 250 and the token housing 130. In response to the finger pushing the front side of the token 120 spatially above the magnetic bar opening 440, an opposite end of the front side of the token 120 is displaced away from the front side of the token housing 130. In another example, a finger or other object may push the backside of the selectively attachable token 120 between the magnetic bar opening 440. In response to applying force at the backside of the token 120 through the opening, the corresponding end of the token 120 is displaced above the surface of the token housing 130.

Figure 3:
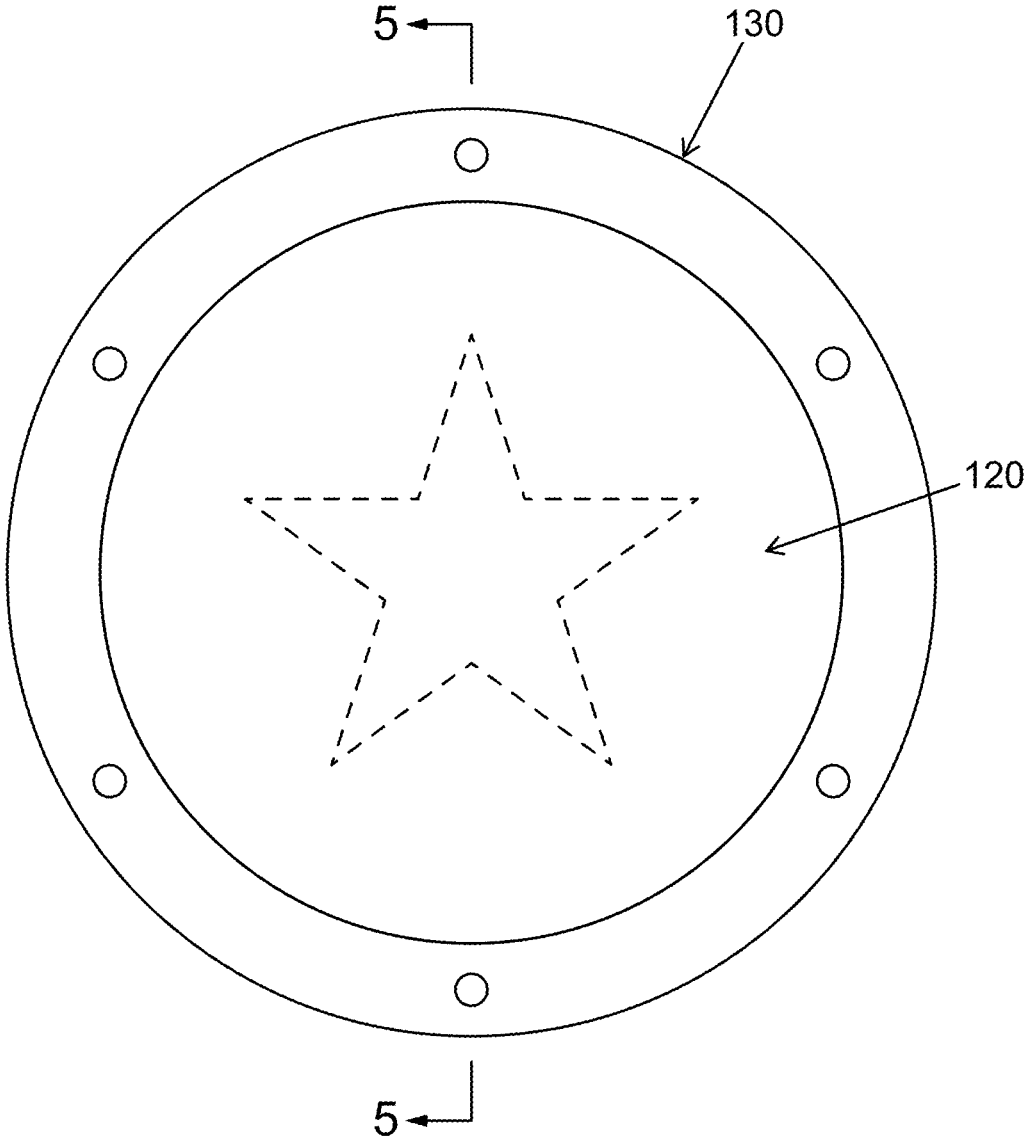
FIG. 3 depicts an example of a front view of a token housing with the selectively attachable token in a coupled state to the token housing.

FIG. 3 depicts an example of a front view of a token housing 130 with the selectively attachable token 120 in a coupled state to the token housing 130. The selectively attachable token 120 may be inserted into the token housing 130 by aligning the inner side edge of the token housing 130 with the outer side edge of the selectively attachable token 120. In some embodiments, the selectively attachable token 120 may be inserted into the token housing 130 by rotating the inner side edge of the token housing 130 against the outer side edge of the selectively attachable token until the profile of the selectively attachable token 120 matches the profile of the token housing 130. A profile match may have corresponding protrusions and recessions, smooth edges, or jagged edges between the token housing 130 and the selectively attachable token 120.

The token housing 130 may be in a coupled state in response to the selectively attachable token 120 being magnetically attached to the magnetic bar 250. In the coupled state, the selectively attachable token 120 may be flush with the front side of the token housing 130. The token housing 130 may be in a decoupled state in response to the selectively attachable token 120 being magnetically decoupled from the magnetic bar 250. In the decoupled state, the selectively attachable token 120 may be displaced away from the front side of the token housing 130. In the coupled state, the selectively attachable token 120 may be flush with the inner side edge of the token housing 130. In the decoupled state, the selectively attachable token 120 may be displaced away from the inner side edge of the token housing 130. In some embodiments, the token housing 130 may include an opening at the backside through which a force may be applied to the token 120 for decoupling the selectively attachable token 120 from the token housing 130.

Unlike other systems, the token housing 130 may provide a smooth inner receptacle surface that is advantageous for exchanging medals. The smooth inner receptacle surface is conducive for easily removing and inserting tokens. The smooth inner receptacle surface may extend around the inside perimeter or the inside circumference of the token housing 130 to provide a profile configured to receive an outer edge profile of various tokens. In some embodiments, the flat inner receptacle can have a jagged or textured surface that at least partially extends around the inner perimeter or the inner circumference of the token housing 130. This jagged or textured inner surface may have a unique profile to allow proper orientation of the token 120 in relation to the token housing 130. In some embodiments, the jagged or textured inner surface may have a unique profile to allow the coupling of tokens having a matching profile.

Figure 4:
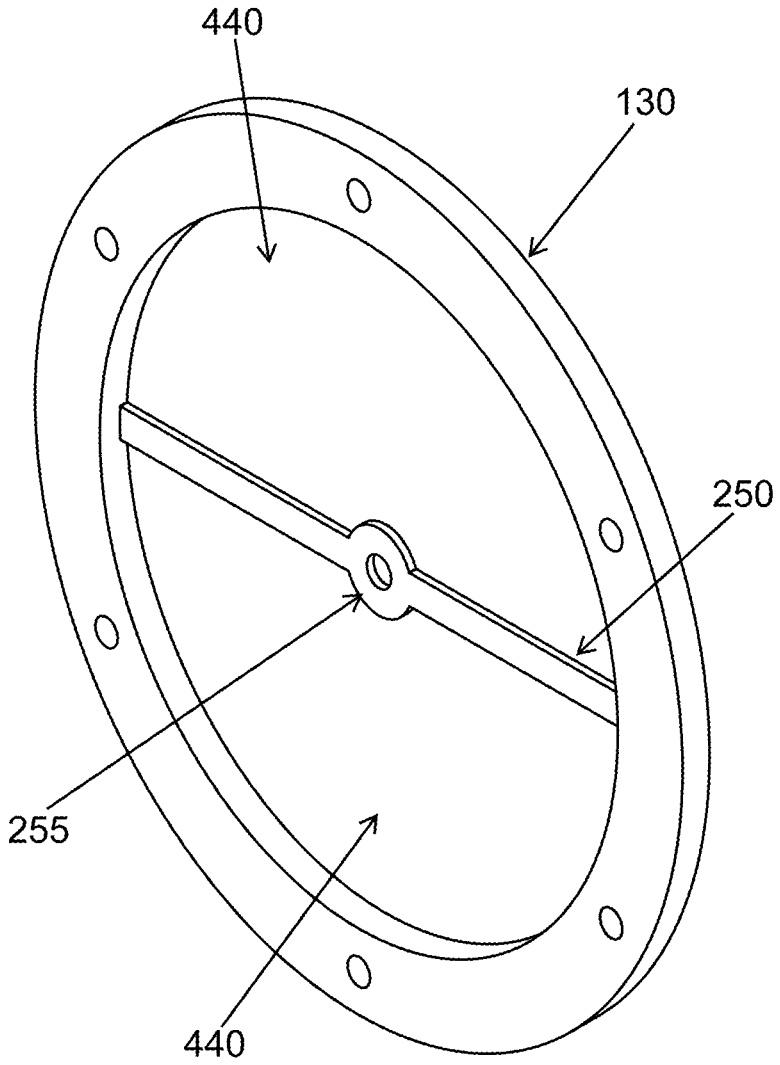
FIG. 4 depicts an example of an angled front view of the token housing.

FIG. 4 depicts an example of an angled front view of the token housing 130. The token housing 130 may include a magnetic bar 250 inserted in the aperture. The magnetic bar 250 may have a thickness less than the thickness of the token housing 130. The magnetic bar 250 may be coupled to the backside of the token housing 130. In some embodiments, the magnetic bar 250 may protrude beyond the backside of the magnetic housing.

The magnetic bar 250 may be magnetic for selectively coupling the token housing 130 to the selectively attachable token 120. The magnetic bar 250 may be magnetic and flat on the side facing toward the front side of the token housing 130. The magnetic bar 250 may extend horizontally or vertically across the cutout of the metal housing. In some embodiments, the magnetic bar 250 may be flush with a backside of the rectangular token housing or may mounted to the bottom of the backside of the rectangular token housing. In some embodiments, the entire magnetic bar 250 may be magnetic. In other embodiments, a magnetic center portion 255 of the magnetic bar 250 may be wider than the remaining portion of the magnetic bar 250 and may include a higher magnetic surface area compared to the remaining portion of the magnetic bar 250.

The magnetic bar 250 may extend from one inner side edge of the token housing 130 to the other inner side edge of the token housing 130. In some embodiments, the magnetic bar 250 may divide the aperture formed by the token housing 130 into two sections. The selectively attachable token 120 may extend into one of the two sections in response to a force pressing the selectively attachable token 120. The magnetic bar 250 may span the inner diameter of the circular band or the inner perimeter of the polygonal band. The magnetic bar 250 may be magnetic for selectively attaching and removing the token 120 inserted into the token housing 130. The token housing 130 may include a backside. In some embodiments, the magnetic bar 250 may be flush with the backside of the token housing 130 or the magnetic bar 250 may be mounted to the bottom of the backside of the token housing 130.

In some embodiments, the magnetic bar 250 may be substituted for a rubber backing with flexible walls. The backside of the rubber backing may be pushed towards the front side of the token housing 130 to selectively detach the token 120. Similarly, the front side of the rubber backing may be pushed towards the backside of the token housing 130 to create a cavity for receiving the token 120.

In some embodiments, the token housing 130 may, instead of a magnet, alternatively use Velcro, a snap, adhesive, compression, or other connecting devices. In one embodiment, instead of a magnet, the token housing 130 can hold the attachable token 120 in place using pressure, by having it snap into place snuggly. To remove the attachable token, it can be pressed out—either from behind or by applying a force to the front side of the token 120 at a point spatially above or below the magnetic bar opening 440.

Figure 5:
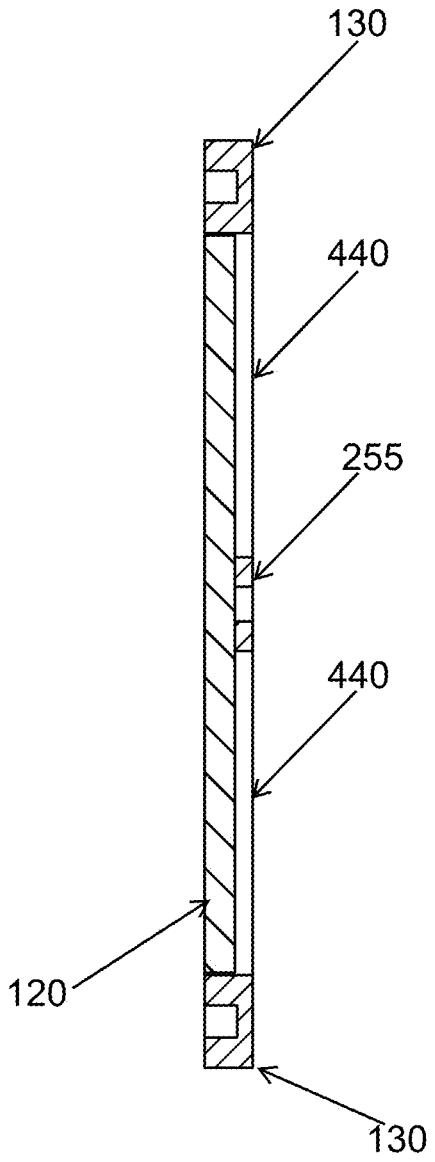
FIG. 5 depicts an example of a side view of a cross-section of the token housing with the selectively attachable token in a coupled state to the token housing.

FIG. 5 depicts an example of a side view of a cross-section of the token housing 130 with the selectively attachable token 120 in a coupled state to the token housing 130. In the coupled state, the selectively attachable token 120 may span from one inner side edge of the token housing 130 to the opposite inner side edge of the token housing 130. In the coupled state, the selectively attachable token 120 may be coupled to the magnetic bar 250 at the center portion of the magnetic bar 250 such that the top surface of the token housing 130 and the top surface of the selectively attachable token 120 are flush. In the coupled state, the inner side edge of the token housing 130 may be aligned with the outer side edge of the selectively attachable token 120.

In some embodiments, the attachable token 120 is a coin. Alternatively still, the token 120 can be a medal coin. Alternatively still, the attachable token can be reversible, such that there are different symbols, slogans, logos, or designs on either side. Alternatively, there are the same symbols, slogans, logos, or designs on both sides of the attachable token.

In some embodiments, the thickness of the token housing 130 may be approximately the same thickness as the token 120 inserted into the token housing 130. In some embodiments, the thickness of the token housing 130 may be approximately the same thickness as the attachable token plus the thickness of the magnetic bar 250 to allow the token 120 to be flush with the front side of the token housing 130. In some embodiments, the thickness of the magnetic bar 250 may be the difference between the token housing 130 and the selectively attachable token 120. In some embodiments, the thickness of the selectively attachable token 120 may be the difference between the token housing 130 and the magnetic bar 250.

Figure 6:
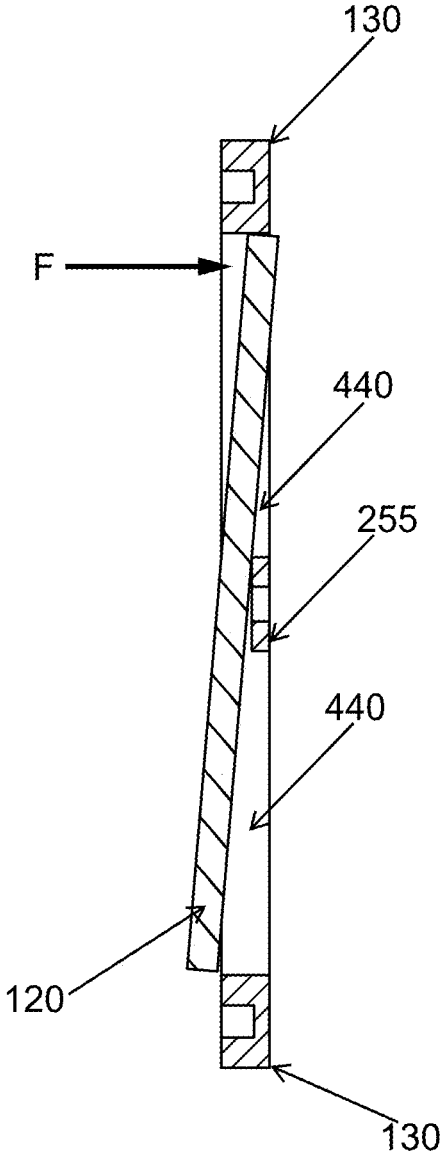
FIG. 6 depicts an example of a side view of a cross-section of the token housing with the selectively attachable token in a partially decoupled state to the token housing.

FIG. 6 depicts an example of a side view of a cross-section of the token housing 130 with the selectively attachable token 120 in a partially decoupled state to the token housing 130. The magnetic bar 250 may divide the aperture formed by the token housing 130 into two sections. The selectively attachable token 120 may extend into one of the two sections in response to a force pressing the selectively attachable token 120.

To facilitate transitioning between these coupled and uncoupled state, the magnetic bar 250 may form two magnetic bar openings 440 between the magnetic bar 250 and the inner side edges of the token housing 130. To transition from a coupled state to a decoupled state, a user may apply force to the token housing 130 at a point corresponding to the magnetic bar openings 440 formed by the magnetic bar 250. In response to applying force above or below one of the magnetic bar openings 440, the opposite end of the token 120 is displaced above the surface of the token housing 130 to allow for easy removal. For example, a finger or other object may apply a force to the front side of the token 120 at a point spatially above or below the magnetic bar opening 440. In response to the finger pushing the front side situated spatially above or below the magnetic bar opening 440, an opposite end of the front side of the token 120 is displaced away from the front side of the token housing 130. In another example of decoupling the selectively attachable token 120, a finger or other object may push the backside of the selectively attachable token 120 between the magnetic bar opening 440. In response to applying force at the backside of the selectively attachable token 120, the corresponding end of the selectively attachable token 120 is displaced above or below the surface of the token housing 130.

Figure 7:
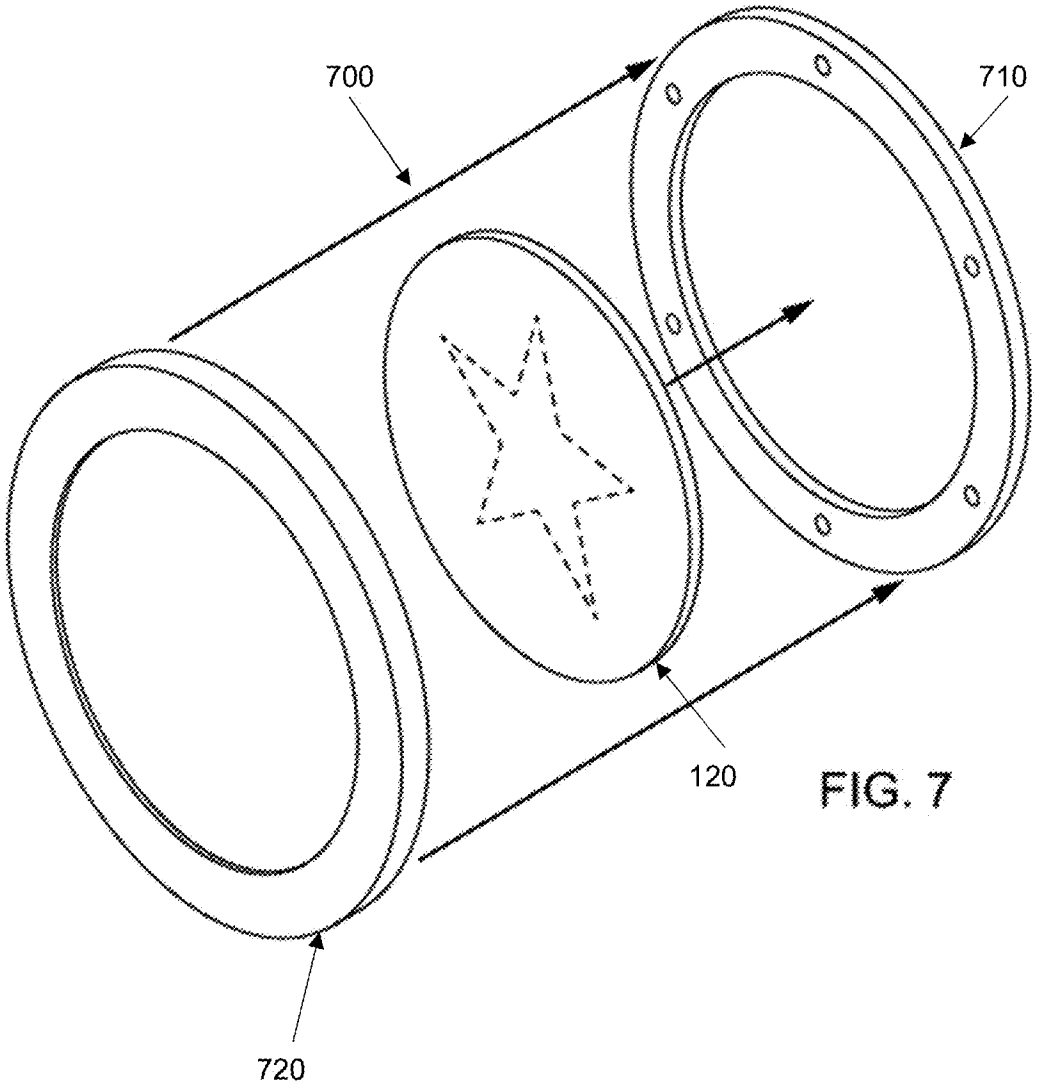
FIG. 7 depicts an example of an exploded view of a rimmed token housing in a decoupled state with a selectively couplable rim configured to sustain a selectively attachable token against an embedded housing interface of the rimmed token housing.

FIG. 7 depicts an example of an exploded view of a rimmed token housing 700 in a decoupled state with a selectively couplable rim 720 configured to sustain a selectively attachable token 120 against an embedded housing interface 710 of the rimmed token housing 700. The embedded housing interface 710 may include a rim interface for coupling to the selectively couplable rim. The selectively couplable rim 720 may partially overlap the selectively attachable token 120 to sustain the token 120 against the embedded housing interface 710.

The embedded housing interface 710 may include a front side and a back side opposite the front side. The front and back sides of the embedded housing interface 710 may be connected to an inner side edge and an outer side edge. The front side of the embedded housing interface 710 may include the rim interface configured to receive the token 120. Additionally, and/or alternatively, the outer side edge or the inner side edge may include the rim interface configured to receive the token 120. The back side may extend between the inner side edges of the embedded housing interface 710. Additionally, and/or alternatively, the backside may include a partial opening to facilitate the removal of the selectively couplable token 120. The rim interface may include a series of protrusions or recessions. For example, the rim interface may include a plurality of recesses for sustaining the selectively attachable token 120 against the embedded housing interface 710.

The selectively couplable rim 720 may be configured to sustain the selectively attachable token 120 against the embedded housing interface 710 after inserting the token 120 into the embedded housing interface 710. The selectively couplable rim 720 may have an outer surface and an inner surface. The outer surface may face away from the fashion accessory 110 and embedded housing interface 710 and the inner surface may face towards the fashion accessory 110 and the embedded housing interface 710. The selectively couplable rim 720 may include a plurality of protrusions extending around the inside surface of the selectively couplable rim 720. The plurality of protrusions may extend around the circumference or perimeter of the inside surface of the selectively couplable rim 720. The plurality of protrusions may be selectively inserted into the plurality of recesses at the embedded housing interface 710 to sustain the selectively attachable token 120 against the embedded housing interface 710.

In some embodiments, the embedded housing interface 710 may be ring-shaped. The front side of the embedded housing interface 710 may have a circular band with a circular cutout at the inner portion of the circular band. The circular band with the circular cutout extending along an inner circumference of the inner side edge may form the ring shape of the embedded housing interface 710. The circular cutout may form a recess at the inner circumference of the inner side edge of the embedded housing interface 710. The token housing 130 may include a backside. In addition to the embedded housing interface 710 having a ring shape, the embedded housing interface 710 may have any circular curves, including an oval, an ellipse, or a circle.

In some embodiments, the embedded housing interface 710 may be rectangular or square-shaped. The front side of the embedded housing interface 710 may have a rectangular band with a rectangular cutout at the inner portion of the rectangular band. The inner portion of the rectangular band may correspond to the inner side edge of the embedded housing interface 710. The rectangular band with the rectangular cutout extending along an inner perimeter of the inner side edge may form the rectangular shape of the embedded housing interface 710. The rectangular cutout may form a recess extending between the inner side edge of the embedded housing interface 710. In addition to the embedded housing interface 710 having a rectangular shape, the embedded housing interface 710 may have any polygon shape, including a triangle, a square, a pentagon, a hexagon, a heptagon, an octagon, or a decagon.

The selectively attachable token 120 may have a back edge configured to be inserted into the embedded housing interface 710 and an outer side edge configured to be received by the embedded housing interface 710. The outer side edge can have a profile that is configured to match a profile at the embedded housing interface 710. In some embodiments, the selectively attachable token 120 may have a smooth outer edge surface that is advantageous for exchanging tokens. The smooth outer side edge may extend around the outer perimeter or the outer circumference of the selectively attachable token 120 to provide a profile configured to be received at a corresponding perimeter or outer circumference at the embedded housing interface 710 and an outer side edge configured to be received by the embedded housing interface 710. The outer side edge of the token 120 has a profile that is configured to match a profile at the embedded housing interface 710. The smooth outer side edge may extend around the outer perimeter or the outer circumference of the selectively attachable token 120 to provide a profile configured to be received at a corresponding perimeter or outer circumference at the embedded housing interface 710. In some embodiments, the outer side edge has a jagged or textured surface that at least partially extends around the outer perimeter or the outer circumference of the token 120. This jagged or textured outer surface may have a unique profile to allow proper orientation of the token 120 in relation to the embedded housing interface 710. In some embodiments, the jagged or textured outer side edge may have a unique profile to allow only the coupling of tokens with a matching profile at the token housing 130.

The embedded housing interface 710 may be mounted to various fashion accessories (e.g., a ballcap). In relation to the fashion accessory 110 to which the embedded housing interface 710 is mounted, the embedded housing interface 710 may provide a stand-off profile to make the token housing 130 and insertable token 120 stand off from the fashion accessory 110 (e.g., the front side of the ball cap). In some embodiments, the embedded housing interface 710 may have a flush profile for a continuous even surface between the fashion accessory 110 (e.g., ball cap) and the embedded housing interface 710. The embedded housing interface 710 may be sewn, embedded, adhered, Velcroed, or other otherwise attached to the fashion accessory 110. Other fashion accessories may include hats, footwear, shirts, belts, and other apparel.

In some embodiments, the embedded housing interface 710 may include an edge or projection that radially extends from the edge of the embedded housing interface 710 for coupling the fabric of the fashion accessory 110 to the embedded housing interface 710. The embedded housing interface 710 may be coupled to the fashion accessory 110 with an adhesive, stitching, snapping, compression, Velcro, and/or the like. The front side of the embedded housing interface 710 may be made with a metal or metal alloy housing, a rubber material, a plastic material, a leather material, and/or the like.

Figure 8:
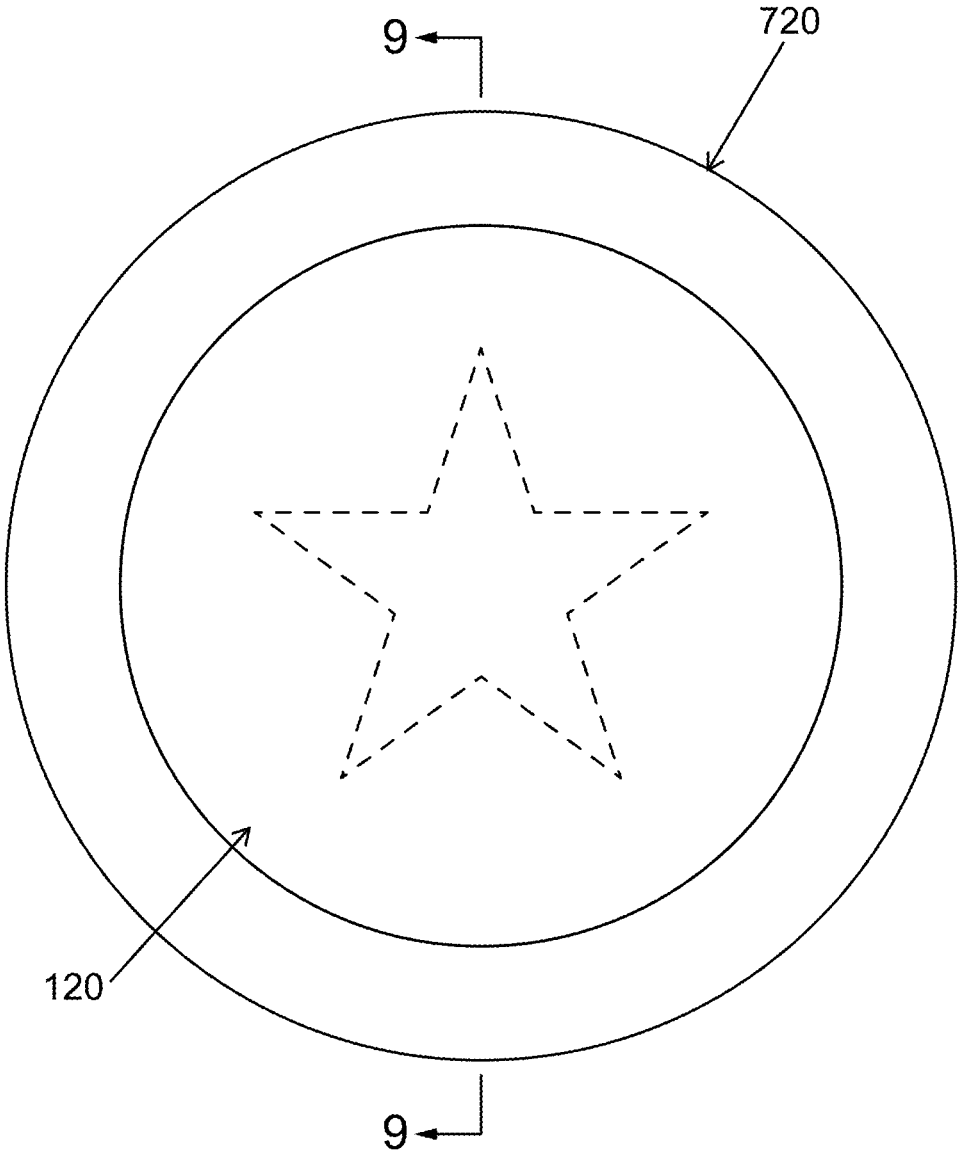
FIG. 8 depicts an example of a front view of the rimmed token housing in a coupled state with a selectively couplable rim configured to sustain the selectively attachable token against the embedded housing interface of the rimmed token housing.

FIG. 8 depicts an example of a front view of the rimmed token housing 700 in a coupled state with a selectively couplable rim 720 configured to sustain the selectively attachable token 120 against the embedded housing interface 710 of the rimmed token housing 700.

The rimmed token housing 700 may be in a coupled state or a decoupled state based on the selectively couplable rim 720 being connected to the embedded housing interface 710. The rimmed token housing 700 may be in a coupled state in response to connecting the rim interface with the selectively couplable rim 720 to the embedded housing interface 710 (e.g., the plurality of protrusions being inserted into the plurality of recesses). In the coupled state, the selectively attachable token 120 may be sandwiched between the front side of the token housing 130 and the backside of the selectively couplable rim 720. Additionally, the selectively attachable token 120 may be flush with the inner side edge of the embedded housing interface 710 in the coupled state. In the coupled state, the rimmed token housing 700 may retain the selectively attachable token 120 in response to shaking, jostling, vibrating, or any other repetitive or chaotic movement of the fashion accessory 110 coupled to the token housing 130.

The rimmed token housing 700 may be in a decoupled state in response to disconnecting the rim interface from the embedded housing interface 710 (e.g., disconnecting the plurality of protrusions being separated from the plurality of recesses). In the decoupled state, the selectively attachable rim may be displaced away from the front side of the embedded housing interface 710. In the decoupled state, the selectively attachable rim may be displaced away from the inner side edge of the embedded housing interface 710 in response to disconnecting the selectively couplable rim 720. In the decoupled state, the selectively attachable token 120 may be removed or inserted into the embedded housing interface 710.

Figure 9:
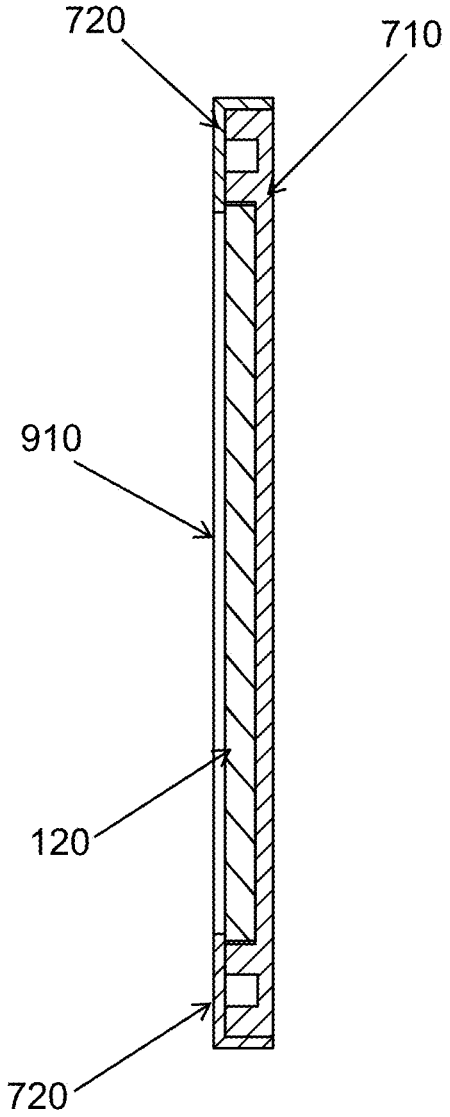
FIG. 9 depicts an example of a side view of a cross-section of the rimmed token housing in a coupled state with a selectively couplable rim configured to sustain the selectively attachable token against the embedded housing interface of the rimmed token housing.

FIG. 9 depicts an example of a side view of a cross-section of the rimmed token housing 700 in a coupled state with a selectively couplable rim 720 configured to sustain the selectively attachable token 120 against the embedded housing interface 710 of the rimmed token housing 700. In the coupled state, the selectively attachable token 120 may span from one inner side edge of the token housing 130 to the opposite inner side edge of the embedded housing interface 710. In the coupled state, the selectively attachable rim may be coupled to the rim interface of the embedded housing interface 710 such that the top surface of the embedded housing interface 710 and the bottom surface of the selectively attachable rim are flush. In the coupled state, the inner side edge of the embedded housing interface 710 may be aligned with the outer side edge of the selectively attachable token 120. In some embodiments, the selectively couplable rim 720 may include a transparent cover for protecting the token 120.

In some embodiments, the thickness of the embedded housing interface 710 may be approximately the same thickness as the token 120 inserted into the embedded housing interface 710. In some embodiments, the thickness of the embedded housing interface 710 may be approximately the same thickness as the token 120 plus the thickness of the back side of the embedded housing interface 710 to allow the token 120 to be flush with the front side of the embedded housing interface 710. In some embodiments, the thickness of the backside of the embedded housing interface 710 may be the difference between the embedded housing interface 710 and the selectively attachable token 120. In some embodiments, the thickness of the selectively attachable token 120 may be the difference between the embedded housing interface 710 and the backside of the embedded housing interface 710.

Figure 10:
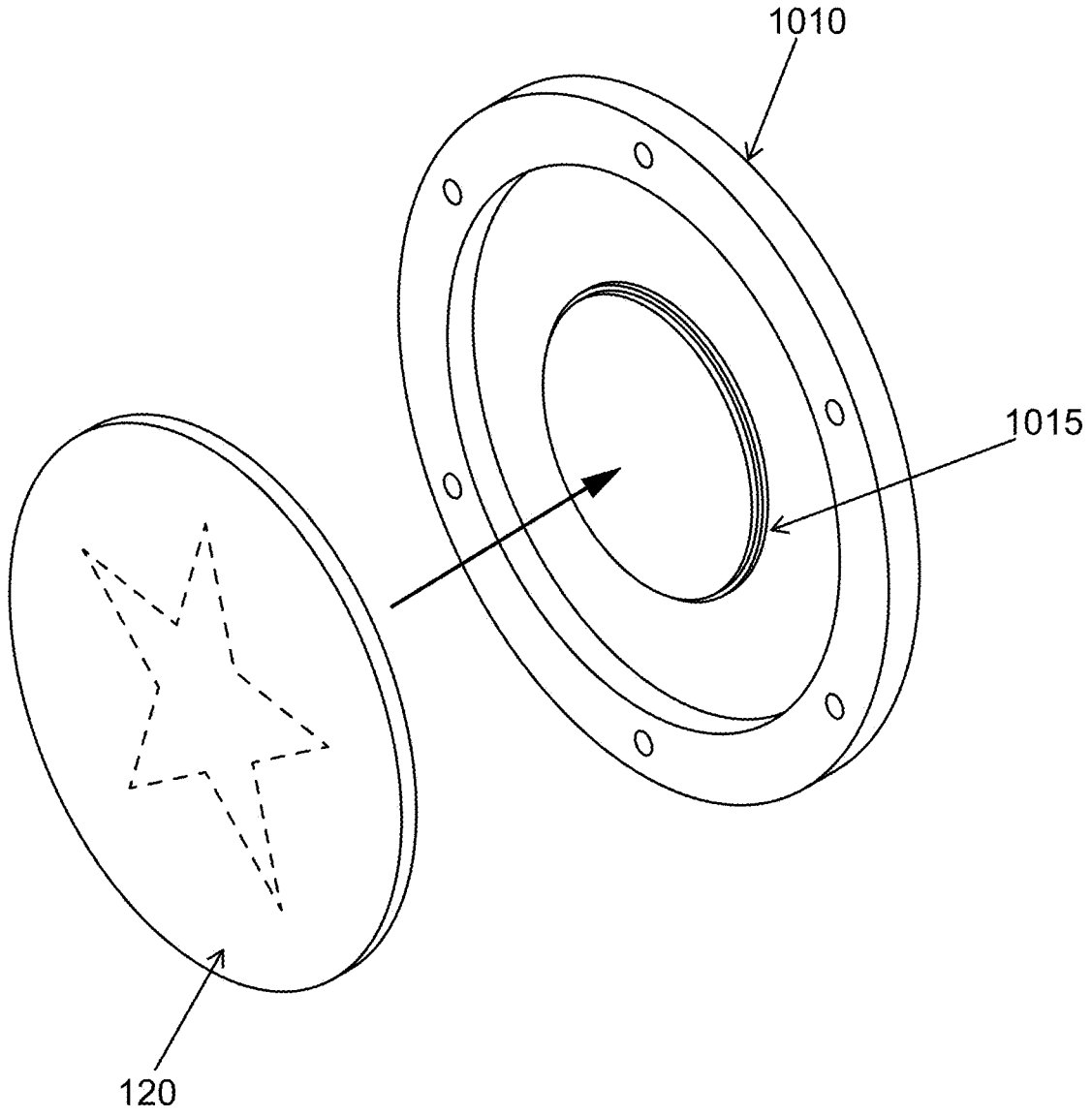
FIG. 10 depicts an example of an angled view of a back-walled token housing with the selectively attachable token in a decoupled state to the token housing.

FIG. 10 depicts an example of an angled view of a magnetic back-walled token housing 1010 with the selectively attachable token 120 in a decoupled state to the token housing 130. The magnetic back-walled token housing 1010 may have a subset of features of the token housing 130 and includes a back wall with a protruding magnet 1015 along the back side of the magnetic back-walled token housing 1010.

The magnetic back-walled token housing 1010 may include a front side and a back side opposite the front side. The front and back sides may be connected with an inner side edge and an outer side edge. The front side of the magnetic back-walled token housing 1010 is configured to receive the token 120. The back side may include a back wall with the protruding magnet 1015 where the protruding magnet 1015 protrudes from the back wall toward the front side of the magnetic back-walled token housing 1010.

The magnetic back-walled token housing 1010 may be in a coupled state or a decoupled state with the selectively attachable token 120. The magnetic back-walled token housing 1010 may be in a coupled state in response to the selectively attachable token 120 being magnetically attached to the protruding magnet 1015. In the coupled state, the selectively attachable token 120 may be flush with the front side of the magnetic back-walled token housing 1010. Additionally, the selectively attachable token 120 may be flush with the inner side edge of the magnetic back-walled token housing 1010 in the coupled state. In the coupled state, the magnetic back-walled token housing 1010 may retain the selectively attachable token 120 in response to shaking, jostling, vibrating, or any other repetitive or chaotic movement of the fashion accessory 110 coupled to the magnetic back-walled token housing 1010.

The magnetic back-walled token housing 1010 may be in a decoupled state in response to the selectively attachable token 120 being magnetically decoupled from the protruding magnet 1015. In the decoupled state, the selectively attachable token 120 may be displaced away from the front side of the magnetic back-walled token housing 1010. In the decoupled state, the selectively attachable token 120 may be displaced away from the inner side edge of the magnetic back-walled token housing 1010.

To facilitate transitioning between these states, the protruding magnet 1015 may stand off from the backside of the magnetic back-walled token housing 1010. In the coupled state, the protruding magnet 1015 creates a gap 1210 between the backside of the magnetic back-walled token housing 1010 and the coupled token 120. To transition from a coupled state to a decoupled state, a user may apply force to the token 120 at a point corresponding to the gap 1210 formed by the protruding magnet 1015. In response to applying force above or below gap 1210 at the token 120, the opposite end of the token 120 is displaced above the surface of the magnetic back-walled token housing 1010 to allow for easy removal. For example, a finger or other object may apply force to the front side of the selectively attachable token at a point spatially above or below the gap 1210. In response to the finger pushing the front side spatially above or below the gap 1210, an opposite end of the front side of the token 120 is displaced away from the front side of the magnetic back-walled token housing 1010.

Figure 11:
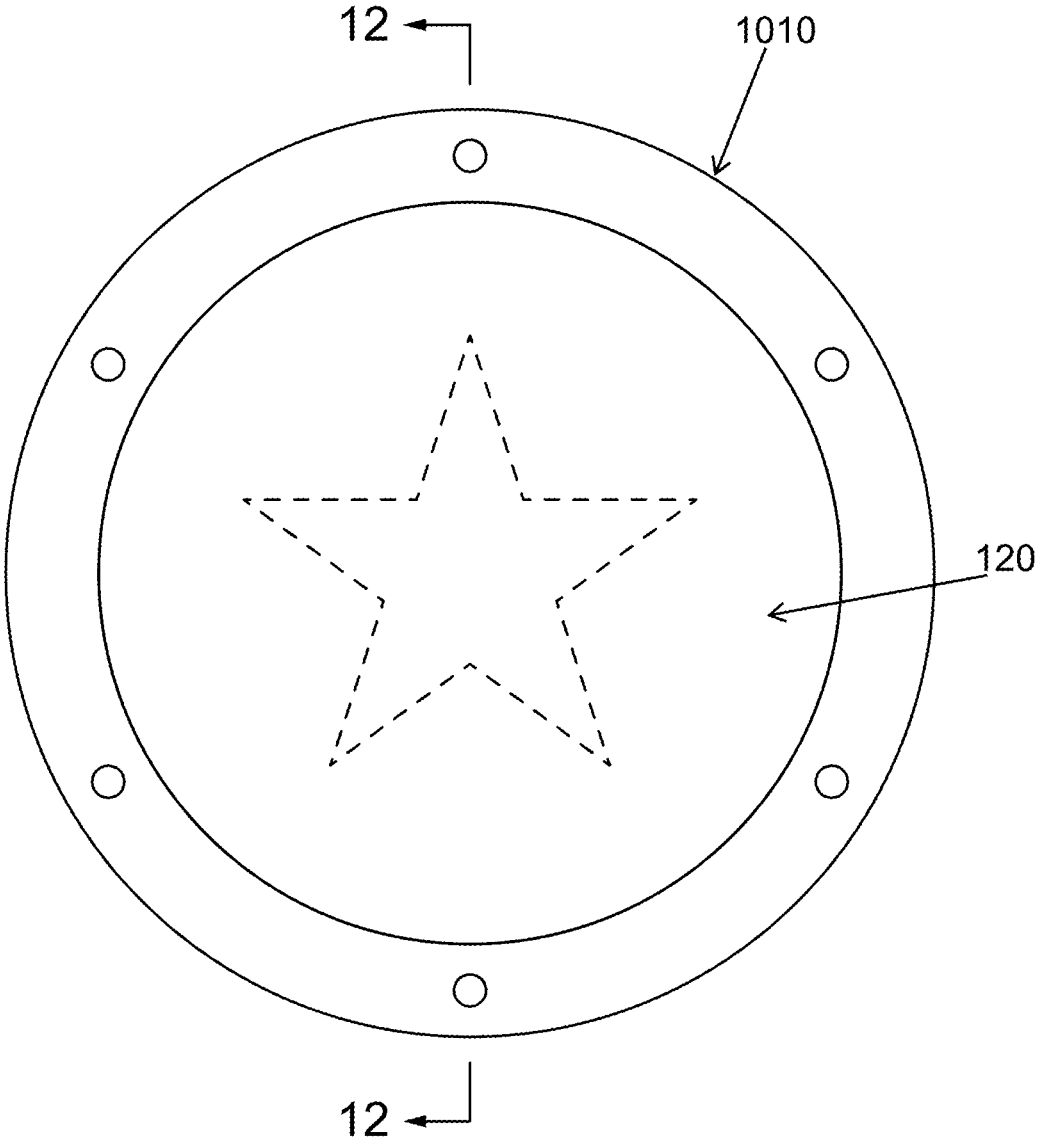
FIG. 11 depicts an example of a front view of a back-walled token housing with the selectively attachable token in a coupled state to the token housing.

FIG. 11 depicts an example of a front view of a back-walled token housing 130 with the selectively attachable token 120 in a coupled state to the token housing 130. The selectively attachable token 120 may be inserted into the magnetic back-walled token housing 1010 by aligning the inner side edge of the magnetic back-walled token housing 1010 with the outer side edge of the selectively attachable token 120. In some embodiments, the selectively attachable token 120 may be inserted into the magnetic back-walled token housing 1010 by rotating the inner side edge of the magnetic back-walled token housing 1010 against the outer side edge of the selectively attachable token 120 until the profile of the selectively attachable token 120 matches the profile of the token housing 130. A profile match may have corresponding protrusions and recessions, smooth edges, jagged edges between the token housing 130 the selectively attachable token 120.

The magnetic back-walled token housing 1010 may be in a coupled state in response to the selectively attachable token 120 being magnetically attached to the protruding magnet 1015. In the coupled state, the selectively attachable token 120 may be flush with the front side of the magnetic back-walled token housing 1010. The token housing 130 may be in a decoupled state in response to the selectively attachable token 120 being magnetically decoupled from the protruding magnet 1015. In the decoupled state, the selectively attachable token 120 may be displaced away from the front side of the magnetic back-walled token housing 1010. In the coupled state, the selectively attachable token 120 may be flush with the inner side edge of the magnetic back-walled token housing 1010. In the decoupled state, the selectively attachable token 120 may be displaced away from the inner side edge of the magnetic back-walled token housing 1010.

Figure 12:
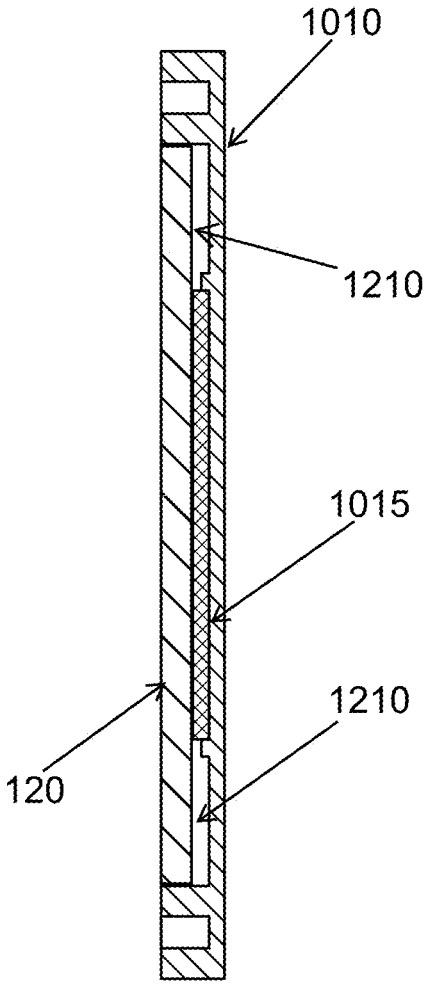
FIG. 12 depicts an example of a side view of a cross-section of the back walled token housing with the selectively attachable token in a coupled state to the token housing.

FIG. 12 depicts an example of a side view of a cross-section of the back walled token housing 130 with the selectively attachable token 120 in a coupled state to the token housing 130. In the coupled state, the selectively attachable token 120 may span from one inner side edge of the magnetic back-walled token housing 1010 to the opposite inner side edge of the magnetic back-walled token housing 1010. In the coupled state, the selectively attachable token 120 may be coupled to the protruding magnet 1015 at the center portion of the back wall such that the top surface of the token housing 130 and the top surface of the selectively attachable token 120 are flush. In the coupled state, the inner side edge of the magnetic back-walled token housing 1010 may be aligned with the outer side edge of the selectively attachable token 120.

In some embodiments, the thickness of the magnetic back-walled token housing 1010 may be approximately the same thickness as the token 120 inserted into the magnetic back-walled token housing 1010. In some embodiments, the thickness of the magnetic back-walled token housing 1010 may be approximately the same thickness as the token 120 plus the thickness of the backside with the protruding magnet 1015 to allow the token 120 to be flush with the front side of the magnetic back-walled token housing 1010. In some embodiments, the thickness of the backside with the protruding magnet 1015 may be the difference between the magnetic back-walled token housing 1010 and the selectively attachable token 120. In some embodiments, the thickness of the selectively attachable token 120 may be the difference between the magnetic back-walled token housing 1010 and the back side with the protruding magnet 1015.

Figure 13:
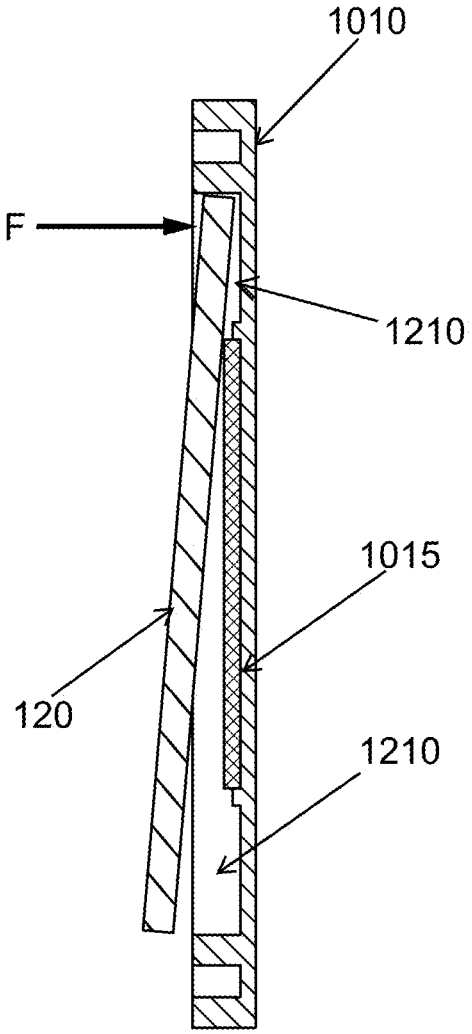
FIG. 13 depicts an example of a side view of a cross-section of the back walled token housing with the selectively attachable token in a partially decoupled state to the token housing.

FIG. 13 depicts an example of a side view of a cross-section of the back walled token housing 130 with the selectively attachable token 120 in a partially decoupled state to the token housing 130. The magnetic back-walled token housing 1010 may be in a decoupled state in response to the selectively attachable token 120 being magnetically decoupled from the protruding magnet 1015. In the decoupled state, the selectively attachable token 120 may be displaced away from the front side of the magnetic back-walled token housing 1010. In the decoupled state, the selectively attachable token 120 may be displaced away from the inner side edge of the magnetic back-walled token housing 1010.

To facilitate transitioning between these states, the protruding magnet 1015 may stand off from the backside of the magnetic back-walled token housing 1010. In the coupled state, the protruding magnet 1015 creates a gap 1210 between the backside of the magnetic back-walled token housing 1010 and the coupled token 120. To transition from a coupled state to a decoupled state, a user may apply force to the token 120 at a point corresponding to the gap 1210 formed by the protruding magnet 1015. In response to applying force above gap 1210 at the token 120, the opposite end of the token 120 is displaced above the surface of the magnetic back-walled token housing 1010 to allow for easy removal. For example, a finger or other object may apply force to the front side of the selectively attachable token at a point spatially above the gap 1210. In response to the finger pushing the front side spatially above the gap 1210, an opposite end of the front side of the token 120 is displaced away from the front side of the magnetic back-walled token housing 1010.

Alternatively, the fashion accessory can include more than one token housing as described herein, which allows for more than one attachable token to be attached to the fashion accessory. For example, in a hat, one token housing can be on the front of the hat and a second on the rear of the hat. Alternatively still, two token housings can appear on the front of the hat. This would allow for two attachable tokens to be attached to the front of the fashion accessory.

Terminology used herein is for the purpose of describing particular embodiments only and is not intended to be limiting of the embodiments. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" may be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

The many features and advantages of the disclosure are apparent from the detailed specification, and thus, it is intended by the appended claims to cover all such features and advantages of the disclosure which fall within the true spirit and scope of the disclosure. Further, since numerous modifications and variations will readily occur to those skilled in the art, it is not desired to limit the disclosure to the exact construction and operation illustrated and described, and accordingly, all suitable modifications and equivalents may be resorted to, falling within the scope of the disclosure.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described above can be directed to various combinations and sub-combinations of the disclosed features and/or combinations and sub-combinations of one or more features further to those disclosed herein. In addition, the logic flows depicted in the accompanying figures and/or described herein do not necessarily require the particular order shown, or sequential order, to achieve desirable results. The scope of the following claims may include other implementations or embodiments.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

While the foregoing is directed to implementations of the present disclosure, other and further implementations of the disclosure may be devised without departing from the basic scope thereof, and the scope thereof is determined by the claims that follow.

What is claimed is:

1. A system comprising:

a token having an authentication identifier to track the authenticity of the token;

an embedded housing interface having a rim interface configured to receive the token in an aperture formed by the rim interface at a front side of the embedded housing interface, the rim interface being configured to selectively couple to a retaining fastener, and the rim interface configured to be at least partially covered by the retaining fastener in response to coupling the retaining fastener to the rim interface;

the retaining fastener being configured to selectively couple to the rim interface, the retaining fastener having an opening through which the token is visible from the front side of the embedded housing interface in response to coupling the retaining fastener to the rim interface, the retaining fastener configured to sustain the token in the aperture formed by the rim interface in response to coupling the retaining fastener to the rim interface; and at least one of a clothing item or a fashion accessory coupled to the embedded housing interface, wherein the token is removable from the aperture formed by the rim interface in response to decoupling the retaining fastener from the rim interface.

2. The system of claim 1, wherein the rim interface is configured to partially overlap the token in response to coupling the retaining fastener to the rim interface.

3. The system of claim 1, wherein the embedded housing interface is in a coupled state in response to attaching the retaining fastener to the rim interface, and wherein the embedded housing interface is in a decoupled state in response to detaching the retaining fastener from the rim interface.

4. The system of claim 3, wherein the token is flush with a top surface of the rim interface in response to the embedded housing interface being in the coupled state.

5. The system of claim 3, wherein the token is flush with an inner side edge of the rim interface in response to the embedded housing interface being in the coupled state.

6. The system of claim 1, wherein the retaining fastener is circular and the rim interface is circular.

7. The system of claim 1, wherein the retaining fastener and the rim interface are configured to selectively couple using at least one of a set of protrusions and recesses.

8. The system of claim 7, wherein the retaining fastener has a protrusion and the rim interface has a recess, and wherein the protrusion of the retaining fastener is inserted into the recess of the rim interface in response to applying the retaining fastener against the rim interface.

9. The system of claim 1, wherein the token may be inserted into the embedded housing interface by rotating the token in the embedded housing interface.

10. An apparatus comprising:

at least one of a clothing item or a fashion accessory having an embedded housing interface, wherein the embedded housing interface includes:

a token having an authentication identifier to track the authenticity of the token;

a rim interface configured to receive the token in an aperture formed by the rim interface at a front side of the embedded housing interface, the rim interface being configured to selectively couple to a retaining fastener, and the rim interface configured to be at least partially covered by the retaining fastener in response to coupling the retaining fastener to the rim interface, the retaining fastener being configured to selectively couple to the rim interface, the retaining fastener having an opening through which the token is visible from the front side of the embedded housing interface in response to coupling the retaining fastener to the rim interface, the retaining fastener configured to sustain the token in the aperture formed by the rim interface in response to coupling the retaining fastener to the rim interface, wherein the token is removable from the aperture formed by the rim interface in response to decoupling the retaining fastener from the rim interface.

11. The apparatus of claim 10, wherein the retaining fastener and the rim interface are configured to selectively couple using at least one of a set of protrusions and recessions.

12. The apparatus of claim 10, wherein the retaining fastener has a protrusion and the rim interface has a recession, and wherein the protrusion of the retaining fastener is inserted into the recession of the rim interface in response to applying the retaining fastener against the rim interface.

13. The apparatus of claim 10, wherein the retaining fastener is circular and the rim interface is circular.

* * * * *